US006988913B2

(12) United States Patent
Zhang

(10) Patent No.: US 6,988,913 B2
(45) Date of Patent: Jan. 24, 2006

(54) ELECTRICAL CONTACT

(75) Inventor: Chi Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/998,853

(22) Filed: Nov. 29, 2004

(65) Prior Publication Data

US 2005/0124223 A1 Jun. 9, 2005

(30) Foreign Application Priority Data

Dec. 3, 2003 (CN) ..... 2003201202582 A

(51) Int. Cl.
*H01R 4/48* (2006.01)

(52) U.S. Cl. ..... 439/637; 439/862

(58) Field of Classification Search ..... 439/637, 439/862

See application file for complete search history.

(56) References Cited

U.S. PATENT DOCUMENTS 2,260,509 A * 10/1941 Chirelstein ..... 439/825
3,131,017 A * 4/1964 Mittler ..... 439/857
3,397,381 A * 8/1968 Gilissen ..... 439/637
3,808,589 A * 4/1974 Bonhomme ..... 439/747
4,087,151 A * 5/1978 Robert et al. ..... 439/188
5,273,461 A * 12/1993 Lee ..... 439/637
5,419,708 A * 5/1995 Koss et al. ..... 439/59
5,667,408 A * 9/1997 Broschard et al. ..... 439/630
5,915,976 A * 6/1999 McHugh ..... 439/74
5,971,809 A 10/1999 Ho
6,120,328 A * 9/2000 Bricaud et al. ..... 439/630
6,220,868 B1 * 4/2001 Pei et al. ..... 439/60

* cited by examiner

*Primary Examiner*—Gary Paumen
(74) *Attorney, Agent, or Firm*—Wei Te Chung

(57) ABSTRACT

An electrical contact (2) comprises a mating portion (23), a preload portion (24) extending away from the mating portion, a retention portion (22) extending from the mating portion and a solder portion (21) for soldering the electrical contact to a printed circuit board. The mating portion has a tab resiliently abutting against the housing. The preload portions and the tabs of the electrical contacts ensure a reliable electrical connection between the electrical contacts and electrical elements mating with the electrical contacts.

5 Claims, 4 Drawing Sheets

ELECTRICAL CONTACT

BACKGROUND OF THE INVENTION

1. Field of the Invention

The present invention is generally related to a type of electrical contacts, and more particularly, to a type of electrical contacts used in card connectors, battery connectors or board to board connectors.

2. Description of Related Art

A variety of electrical connectors are widely used in electronic devices for transmitting signals between them. Electrical connectors each comprise a plurality of electrical contacts for contacting with electrical elements of a complementary connector. For achieving reliable and continuous signals between the electronic devices, the electrical contact must be applied with adequate normal force when the electrical connector with the electrical contacts assembled mates with the complementary connector. Inadequate normal force between the electrical contacts and electrical elements of the complementary connector easily causes signal instability.

U.S. Pat. No. 5,971,809 (the '809 patent) discloses a conventional electrical connector. Referring to FIG. 4 adapted from FIG. 2(A) of the '809 patent, the connector 1 includes an insulated housing 10 and a plurality of first electrical contacts 110 and second electrical contacts 111. The housing 10 comprises a plurality of passageways 1011 in which the first and the second electrical contacts 110, 111 respectively are secured and a plurality of protrusions respectively formed in corresponding passageways. Each electrical contact comprises a mating portion 1101 for electrically contacting with electrical element of a complementary connector, a preload portion 1104 extending forwardly from the mating portion to abut against corresponding protrusion of the housing, a solder portion 1103 for connecting the connector with a printed circuit board and a retention portion 1102 between the mating portion and the solder portion for securing the electrical contact to corresponding passageway of the housing. The second electrical contact comprises a mating portion 1111 for electrically contacting with the electrical element of the complementary connector, a preload portion 1114 extending forwardly from the mating portion to abut against corresponding protrusion, a retention portion 1112 and a solder portion 1113 extending rearwardly from the retention portion. The mating portions of the first and the second electrical contacts are pressed to deform elastically by normal force occurred when the electrical connector is engaging with the complementary connector. The first and the second electrical connector respectively comprise a preload portion which prearranged some elastic deformation to the first and the second electrical contacts. Thus, the normal force applied on the electrical contacts is equivalent to the normal force added by the prearranged elastic deformation and the actual elastic deformation.

However, with the development toward miniaturization and integration of the electronic devices, the electrical connector not only become more and more smaller than before but also required to transmitting signal more stably. This trend of development induces that the electrical contacts should be loaded by adequate normal force. After the electrical connector connecting or disconnecting with its complementary connectors several times, electrical contacts are pressed by the normal force between the electrical contacts and electrical elements of the complementary connector to offset from its correct positions. Thus, the configuration of the conventional electrical connector cannot fulfill the requirement of providing adequate normal force on the electrical contacts.

Hence, an improved type of electrical contacts is highly desired to overcome the aforementioned disadvantages of the prior art.

SUMMARY OF THE INVENTION

Accordingly, an object of the present invention is to provide a type of electrical contacts, whose structure can enable an electrical connector with this type of electrical contacts assembled to transmitting signals more stably.

In order to achieve the object set forth, a type of electrical contacts is provided. Each electrical contact comprises a mating portion for electrically contacting with an electrical element of a complementary connector, a preload portion extending forwardly from the mating portion, a retention portion extending rearwardly from the mating portion to engage with the housing and a solder portion extending from the retention portion to solder the electrical connector to a printed circuit board. The mating portion comprises a tab projecting from one end thereof along a direction which is opposite to that of the preload portion.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
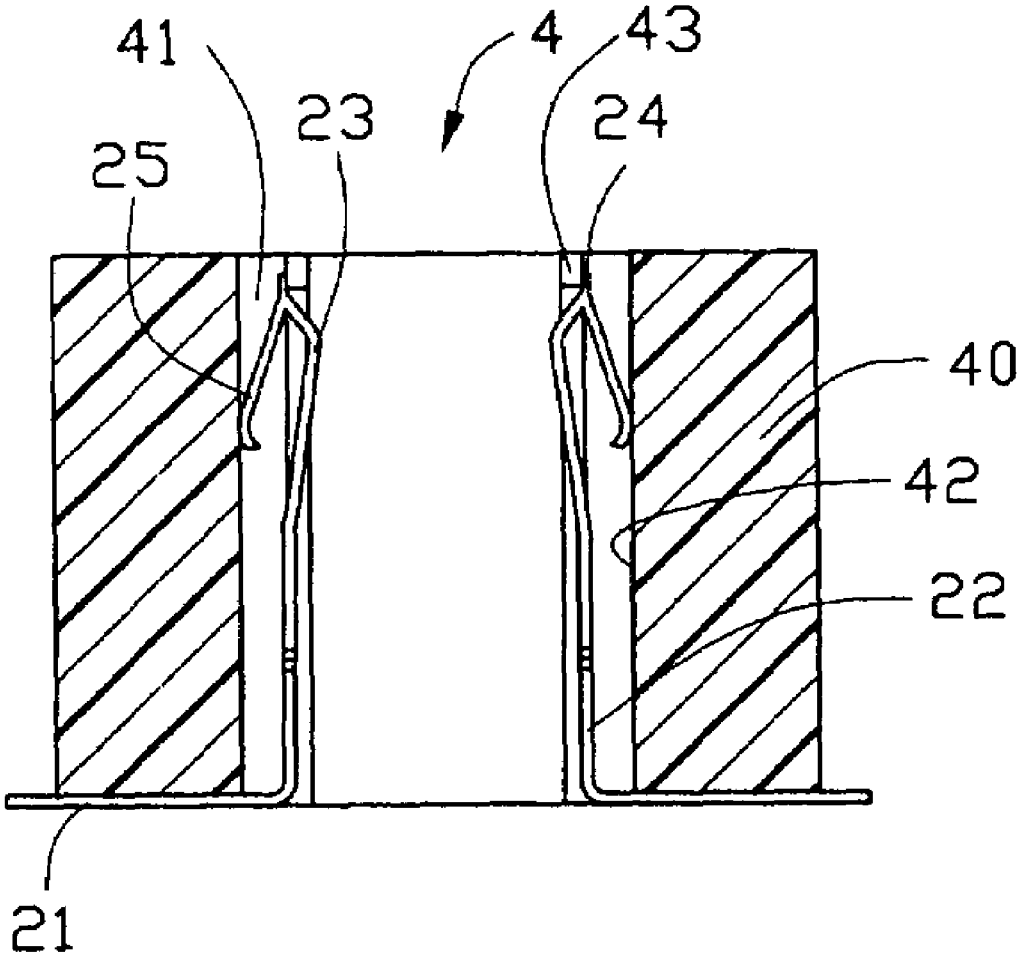
FIG. 1 is a cross-sectional view of an electrical connector, with a plurality of electrical contacts in accordance with the present invention assembled thereto.
Figure 2:
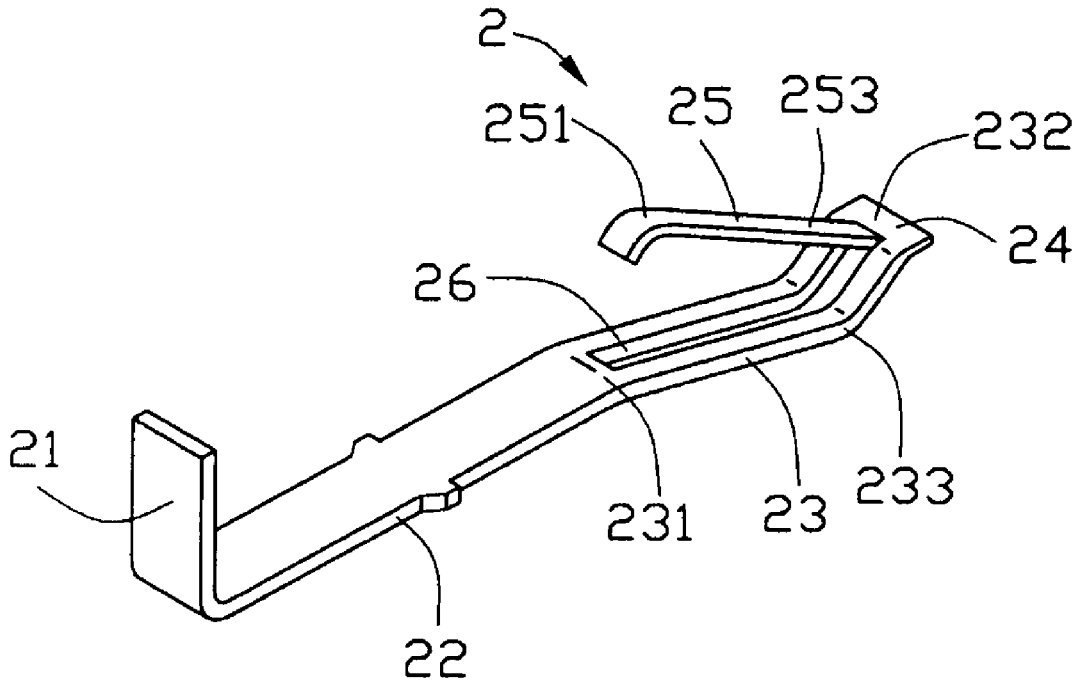
FIG. 2 is a perspective view of the electrical contact.

Referring to FIG. 1 and FIG. 2, an electrical connector 4 comprises an insulated housing 40 and a plurality of electrical contacts 2. The housing 40 includes a plurality of passageways 41 for respectively receiving the electrical contacts 2 and a plurality of protrusions 43 respectively projecting from an inner wall 42 of corresponding passageway 41. Each electrical contact 2 comprises a mating portion 23 for electrically contacting with an electrical element of a complementary connector (not shown), a preload portion 24 extending forwardly from one end 232 of the mating portion 23, a retention portion 22 extending rearwardly from the mating portion 23 to engage with the housing 40 and a solder portion 21 extending from the retention portion 22 to solder the electrical connector 4 to a printed circuit board (not shown). The mating portion 23 comprises a tab 25 projecting from the end 232 thereof adjacent to the preload portion 24 along a direction which is opposite to that of the preload portion 24, a slot 26 formed between the end 232 and the other end 231 thereof adjacent to the retention portion 22 and an arc-shaped contact portion 233. The tab 25 comprises an arm 253 and an angled portion 251 curved along a direction which is opposite to that of the contact portion 233.

When the electrical contacts 2 are respectively assembled into the passageways 41 of the housing 40, the preload portions 24 of the electrical contacts 2 abut against the protrusions 43 to prearrange some elastic deformation to the electrical contacts 2. When the complementary connector is inserted into the housing 40 of the electrical connector 4, the electrical contacts 2 offset from its original position and extend into the passageways 41, and the angled portion 251 of tabs 25 is pressed to abut against and slide along the inner walls 42 of the passageways 41. In the process of insertion of the complementary connector the housing 40 reacts to the electrical contacts 2 via the angled portions 251. As a result, the normal force acted on the electrical contacts 2 is highly increased. Accordingly the electrical connector with this type of electrical contact 2 assembled thereto can fulfill the requirements of the electronic devices.

Figure 3:
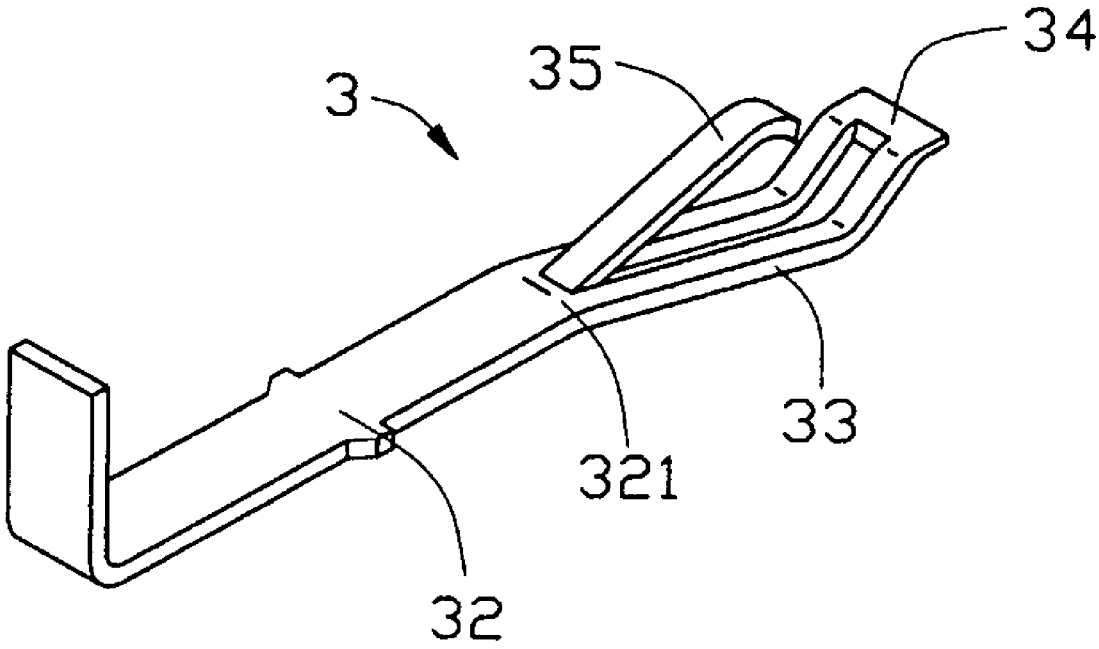
FIG. 3 is a perspective view of the electrical contact in accordance with another embodiment of the present invention.
Figure 4:
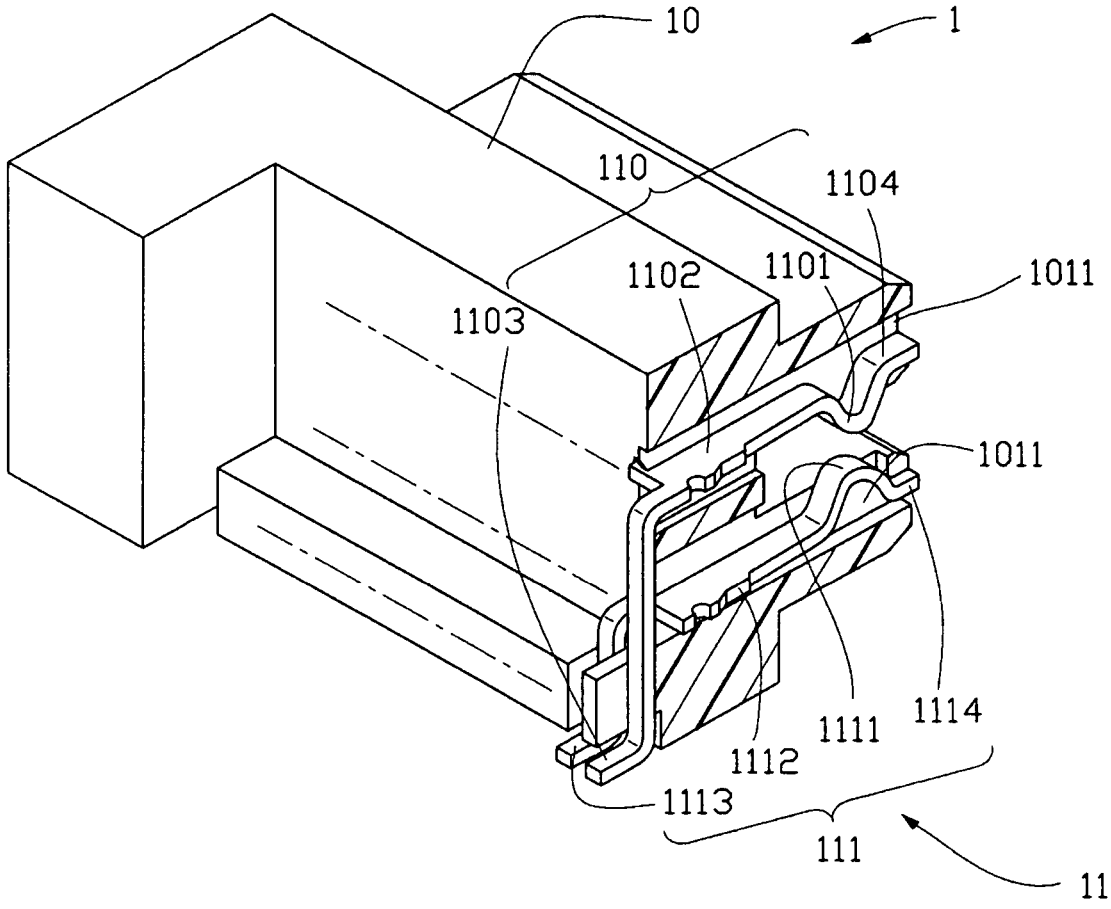
FIG. 4 (PRIOR ART)
FIG. 4 is a sketch, cross-sectional view of an electrical connector of prior art.

Referring to FIG. 3, an electrical contact 3 in accordance with another embodiment of the present invention is shown. Each electrical contact 3 has a similar structure as the electrical contact 2, but the electrical contact 3 has a tab 35 projecting from one end 321 adjacent to a retention portion 32 of the electrical contact 3 along a direction which is the same as that of a preload portion 34 of the electrical contacts 3.

The electrical contacts 2, 3 are not only used in a card connector but also can be used in a battery connector or a board to board connector. With the configuration of the electrical contacts 2, 3, when any electrical connector with this type of electrical contacts 2, 3 assembled mates with its complementary connector, the normal force between the electrical contacts 2, 3 and electrical elements of the complementary connector is enough to enable the electrical connectors to transmitting signals stably and continuously.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulated housing defining a receiving port and a plurality of passageways aside; and a plurality of electrical contacts being assembled into corresponding passageways, each electrical contact comprising a mating portion extending into said receiving port, a tab stamped from the mating portion and extending away from the receiving port to abut against the housing irrespective of whether a complementary connector is received in the receiving port or not, a preload portion extending from an upper end of the mating portion to abut against the housing when no complementary connector is inserted in the receiving port, a retention portion extending from a lower end of the mating portion for fixing the electrical contact in the passageway.

2. The connector as claimed in claim 1, wherein said tab is cantilevered with a root adjacent to said preload portion.

3. The connector as claimed in claim 1, wherein said tab is cantilevered with a root adjacent to said retention portion.

4. The connector as claimed in claim 1, wherein each tab has an angled portion abutting against and sliding along corresponding inner wall of the passageways.

5. The connector as claimed in claim 4, wherein the mating portion has an arc-shaped contact portion curving along a direction away from the angled portion of the tab.

* * * * *